United States Patent [19]

Shim

[11] Patent Number: 4,992,185

[45] Date of Patent: Feb. 12, 1991

[54] STABILITY IMPROVER FOR WATER-IN-OIL EMULSION

[75] Inventor: Joosup Shim, Wenonah, N.J.

[73] Assignee: Mobil Oil Corporation, Fairfax, Va.

[21] Appl. No.: 195,427

[22] Filed: May 11, 1988

[51] Int. Cl.[5] ..... C10M 173/00; C10M 135/04

[52] U.S. Cl. ..... 252/33; 252/45; 252/48.2; 252/49.5; 252/77; 252/78.1

[58] Field of Search ..... 252/33, 49.5, 45

[56] References Cited

U.S. PATENT DOCUMENTS

| | | | |
|---|---|---|---|
| 3,019,190 | 1/1962 | Holzinger | 252/75 |
| 3,080,322 | 3/1963 | Holzinger et al. | 252/75 |
| 3,088,914 | 5/1963 | Holzinger | 252/76 |
| 3,159,580 | 12/1964 | Hammer et al. | 252/75 |
| 3,234,143 | 2/1966 | Waldmann | 252/309 |
| 3,268,447 | 8/1966 | Dickey et al. | 252/33.4 |
| 3,285,851 | 11/1966 | Dyer | 252/32.5 |
| 3,407,143 | 10/1968 | Pitchford | 252/75 |
| 3,909,425 | 9/1975 | Crawford et al. | 252/33 |
| 4,119,550 | 10/1978 | Davis et al. | 252/47 |
| 4,160,739 | 7/1979 | Stambaugh et al. | 252/34 |
| 4,161,452 | 7/1979 | Stambaugh et al. | 252/34 |
| 4,212,750 | 7/1980 | Gorman | 252/33.4 |
| 4,255,447 | 9/1980 | Law et al. | 252/34.7 |
| 4,292,185 | 9/1981 | Bollinger | 252/47.5 |
| 4,419,252 | 12/1983 | Shim | 252/49.5 |
| 4,483,777 | 11/1984 | Shim | 252/49.5 |
| 4,533,482 | 8/1985 | Bollinger | 252/56 R |

OTHER PUBLICATIONS

Smaller & Smith, "Lubricant Additives", 1967.

The Condensed Chemical Dictionary, Hawley, 10th Edition, p. 539.

*Primary Examiner*—Olik Chaudhuri

*Assistant Examiner*—Ellen McAvoy

*Attorney, Agent, or Firm*—A. J. McKillop; C. J. Speciale; H. M. Flournoy

[57] ABSTRACT

A water-in-oil emulsion, having improved stability, is provided which comprises about 40 to 80 percent by weight of an oil of lubricating viscosity; about 10 to less than about 60 percent by weight water, said percentages based on the total weight of the emulsion; a water-in-oil emulsifier; and an emulsion stabilizing amount of a stabilizer selected from the group consisting of sulfurized diisobutylene, sulfurized triisobutylene and mixtures thereof.

17 Claims, No Drawings

STABILITY IMPROVER FOR WATER-IN-OIL EMULSION

This is a continuation of application Ser. No. 016,443, filed on Feb. 20, 1987, now abandoned, which is a continuation of application Ser. No. 778,931, filed on Sep. 23, 1985, now abandoned.

BACKGROUND OF THE INVENTION

1. Field of the Invention

The present invention is directed to an emulsified lubricant. More specifically, the present invention is directed to a water-in-oil emulsion containing sulfurized. diisobutylene and/or triisobutylene. 2. Background of the Prior Art The use of water-in-oil emulsion fluids as lubricants in industrial applications, for example, as hydraulic fluids, and in other applications where lubricants are necessitated is well known to those skilled in the-art. An essential aspect of water-in-oil emulsion lubricants is the presence of oil as the continuous phase with water dispersed therein. The continuous oil phase of the lubricant provides the necessary lubricity. At the same time the discontinuous, dispersed water phase contributes fire-resistance. Thus, water-in-oil emulsion lubricant fluids combine lubricating inflammability characteristics.

A major difficulty in utilizing these otherwise excellent hydraulic lubricating fluids is the possibility of loss of stability of the emulsion. In many water-in-oil emulsions of the prior art water particles tended to agglomerate in clusters and to settle to the lower part of the reservoir in which the fluid was maintained. The result of this emulsion breakdown is a continuous oil phase which is obviously non-fire resistant. Not only does such a result eliminate a major requirement of emulsifiable lubricants, fire resistance, but, moreover, such a condition, in which free water is present, can cause corrosion of lines and working parts as well as rapid wear of pump parts due to lack of lubrication. Obviously, therefore, it is essential that water-in-oil the hydraulic fluids maintain their stability over the long period of time in which they are in service.

A major cause of breakdown of emulsifiable lubricants including hydraulic fluids is high temperature. As those skilled in the art are aware, continued exposure to elevated temperatures tends to breakdown water-in-oil emulsion hydraulic fluids.

The problem of maintaining stability of water-in-oil emulsion hydraulic fluids has been addressed in the prior art U.S. Pat. No. 4,483,777 discloses the use of a stabilizing amount of stabilizer selected from the group consisting of water-soluble aminohydroxy compounds and a heterocyclic amine.

Another additive, provided in water-in-oil emulsion fluids, is reported in U.S. Pat. No. 4,225,447 to produce thermally stable emulsions. The emulsion of this patent includes an additive selected from the group consisting of an alkenylsuccinic anhydride having a number average molecular weight of about 300 to 3,000; the alkenylsuccinic anhydride in combination with a rosin salt; and the anhydride in combination with an amine and a rosin soap.

U.S. Pat. No. 3,407,143 provides a water-in-oil emulsion which is reported to have good high temperature stability by the addition thereto of polyethylene.

Several prior art references teach the use of a calcium petroleum sulfonate as an emulsifier. For example, U.S. Pat. Nos. 3,019,190; 3,159,580 and 3,234,143 all make this disclosure. This emulsifier is usually provided in combination with a stabilizer. In the '190 patent a calcium soap of a long chain aliphatic fatty acid is utilized. The '580 patent stabilizer is a potassium salt of a saturated straight-chain fatty acid. Finally, the '143 patent suggests the calcium petroleum sulfonate be used in combination with an alkali metal hydroxide naphthenic acid.

A similar teaching is made in U.S. Pat. No. 3,268,447. The '447 patent discloses an alkali metal or alkaline earth metal sulfonate as a component in a water-in-oil emulsion fire-resistant fluid.

Other similar teachings utilizing calcium sulfonate as the basic emulsifier include U.S. Pat. Nos. 3,080,322 and 3,088,914. These patents combine the sulfonate emulsifier with naphthenic acid salts or soaps of several metals, with calcium being the particularly preferred metal, as the stabilizing medium, to produce fire-resistant water-in-oil emulsions.

U.S. Pat. No. 3,285,851 describes the utilization of a hydrogenated polyisobutylene as the lubricating oil base in a water-in-oil emulsion. This patent reports that hydrogenated polyisobutylene emulsions are more stable than polybutylene emulsions.

The patents described above all advance the water-in-oil emulsion art. Although they all allege improved emulsion stability there still remains a need in this art for improved water-in-oil emulsion stabilizers which provide protection against breaking of the emulsion when the emulsion is exposed to elevated temperatures over long periods of time.

SUMMARY OF THE INVENTION

It has now been discovered that a new class of water-in-oil emulsion stabilizers, distinguished from the thermal stabilizers of the prior art, has significantly improved long term thermal stability. With the utilization of this stabilizer, water-in-oil emulsions have been found to provide extended periods of stability while being subjected to extreme elevated temperature environments.

In accordance with the present invention a water-in-oil emulsion is provided which comprises about 40 to 80 percent of an oil of lubricating viscosity; about 10 to less than 60 percent water, said percentages being by weight, based on the total weight of the water-in-oil emulsion; and an emulsion stabilizing amount of a stabilizer selected from the group consisting of sulfurized diisobutylene, sulfurized triisobutylene and mixtures thereof.

DETAILED DESCRIPTION

The water-in-oil emulsion fluid of the present invention, principally utilized as a hydraulic fluid, possesses long term thermal stability. In the emulsion fluid of this invention the oil is the continuous phase, constituting about 40 to 80 percent by weight of the total composition. More preferably, the concentration of the continuous phase represents from about 50 to about 70 percent by weight. The discontinuous, dispersed phase is water, constituting from about 10 to less than 70 percent by weight of the total emulsion. More preferably, the water constitutes about 10 to less than 50 percent by weight of the total emulsion.

The continuous oil phase, which provides the lubricant effect, may comprise mineral oils, synthetic oils, especially synthetic hydrocarbon oils, or a combination of mineral oil with synthetic oils of lubricating viscosity. In the preferred embodiment wherein mineral oils are employed as the oil phase, these oils have a viscosity of at least 40 Saybolt Universal seconds (SUS) at 100° F. More preferably, a mineral oil having a viscosity in the range of between about 60 SUS and 300 SUS at 100° F. is typically employed. When synthetic lubricants are utilized, either alone or in addition to mineral oils, various compounds may be utilized for this purpose. Typical synthetic oils include polypropylene glycol, polyalpha-olefins, trimethylolpropane esters, neopentyl and pentaerythritol esters, di-(2-ethylhexyl)-sebacate, di-(2-ethylhexyl)adipate, dibutylphthalate, fluorocarbons, silicate esters, silane esters of phosphorus-containing acids, liquid ureas, ferrocene derivatives, hydrogenated mineral oils, chain-type polyphenyls, siloxanes and polysiloxanes, alkyl-substituted diphenyl ethers typified by a butyl-substituted bis-(p-phenoxyphenyl)ether, phenoxy phenylethers and the like.

The synthetic hydrocarbons which may be used in the present invention are of the type normally made by polymerizing monoolefins in the presence of a suitable catalyst such as boron trifluoride or aluminum trichloride. Lower olefins may be utilized as the monoolefinic monomers provided the degree of polymerization is sufficient. For example, ethylene, propylene, butylene and the like may be utilized as the monoolefin monomer. Typically, however, the monoolefins of the present invention contain at least 10 carbon atoms. One such member is made by trimerizing decene. The synthetic hydrocarbon or polyolefin suitable for use in this invention has an upper limit of about 75 carbon atoms. Hydrocarbon fluids of this type retain their fluidity at lower temperatures and have enhanced resistance to flammability and explosion.

About 0.5 to about 15 percent by weight of the water-in-oil emulsion of this invention is an emulsifier. More preferably, the emulsifier of the present invention constitutes about 1 to 10 weight percent of the emulsion. Among the preferred emulsifiers within the contemplation of the present invention are sulfonate emulsifiers, particularly zinc alkylbenzene sulfonates and amine emulsifiers and mixtures thereof.

In addition to the above components the water-in-oil emulsion fire-resistant hydraulic fluid of the present invention is possessed of high-temperature emulsion stability by the addition thereto of a emulsion stabilizing amount of a stabilizer selected from the group consisting of sulfurized diisobutylene, sulfurized triisobutylene and mixtures thereof.

In a preferred embodiment the emulsion stabilizing amount of the emulsion stabilizers of the present invention constitutes about 0.01 to 2 percent by weight, based on the total weight of the water-in-oil emulsion fluid. More preferably, the concentration preferred to produce emulsion stability is in the range of about 0.05 to 1 percent by weight. Still more preferably, this concentration is in the range of about 0.075 and 0.5 percent by weight. It is emphasized that all percentages by weight are based on the total weight of the emulsion.

The following examples are given to illustrate the present invention. Since these examples are given for illustrative purposes only, the scope of the present invention should not be limited thereto.

EXAMPLE 1

Water-In-Oil Emulsion Base Fluid

A water-in-oil emulsion base fluid was prepared by mixing a 100 SUS paraffinic neutral oil, present in a concentration of 48.6 percent by weight with 43.0 weight percent of distilled water and an emulsifier comprising a mixture of sulfonates, amines, zinc dithiophosphate and ethylene glycol, present in a concentration of 8.4 weight percent, all percentages based on the total weight of the emulsifier. The three components when homogenized produced a thick milky white, smooth, homogeneous water-in-oil emulsion fluid.

EXAMPLES 2–4

Preparation of Stable Water-in-Oil Emulsions

In Example 2, 99.9 parts by weight of the base emulsion fluid of Example 1 were combined with 0.1 part by weight of sulfurized diisobutylene. The sulfurized diisobutylene of this example was produced in a high pressure process. It is noted that a description of a process for producing a class of compounds which includes sulfurized diisobutylene under suproatmospheric pressure (a high pressure process) is provided in U.S. Pat. No. 4,119,550 which is incorporated herein by reference.

In Example 3, 0.1 part by weight of sulfurized diisobutylene produced at low pressure was combined with 99.9 parts by weight of the base fluid. Again, U.S. Pat. No. 4,119,550, which describes a process for making a class of compounds which includes sulfurized diisobutylene under low pressure, i.e., at atmospheric pressure, is incorporated herein by reference.

Example 4 was a duplicate of Examples 2 and 3 except that instead of sulfurized diisobutylene, 0.1 parts by weight of sulfurized triisobutylene was combined with 99.9 parts by weight of the base fluid.

COMPARATIVE EXAMPLES 1 and 2

Preparation of Water-in-Oil Emulsion Containing Non-Inventive Stabilizers

Comparative Example 1 was run to determine the criticality of utilizing sulfurized diisobutylene or triisobutylene rather than sulfurized monoisobutylene. In this example sulfurized monoisobutylene was combined with the base fluid in the same concentration as was the sulfurized isobutylenes of Examples 2–4. That is, 99.9 parts of the base fluid of Example 1 were combined with 0.1 part of sulfurized monoisobutylene.

In Comparative Example 2 an emulsion stabilizer of the prior art, the zinc sulfonate complex of succinimide, was combined with the base fluid of Example 1 in the same concentration ratio, 99.9 parts of the base fluid with 0.1 part of the succinimide. This prior art emulsion stabilizer was particularly selected because it includes sulfur.

EXAMPLE 5

Stability Testing of the Emulsions

The water-in-oil emulsions of Examples 1–4 and Comparison Examples 1 and 2 were tested to determine their emulsion stability. In this test 100 milliliters of each of the emulsions of Examples 1–4 and Comparative Examples 1 and 2 were disposed in a stoppered 100 ml graduated cylinder. The cylinders were placed in a forced air ventilated oven maintained at a temperature of 200° F. Every 24 hours the cylinders containing the 100 ml. samples were inspected. When any of the emulsions demonstrated 10 percent by volume free water, that is, 10 ml of separated water or 15 percent by volume of free oil, that is, 15 ml of continuous phase oil free of water, the emulsion was judged to be no longer stable. At that point the number of days that the emulsion was maintained in the oven was recorded. The results of this test is summarized in the Table below.

TABLE

EMULSION STABILITY OF WATER-IN-OIL EMULSION HYDRAULIC FLUIDS

| | EXAMPLE NO. | | | | | |
|---|---|---|---|---|---|---|
| | 1 | 2 | 3 | 4 | CE1 | CE2 |
| Component, Parts by Wt. | | | | | | |
| W/O Emulsion Base Fluid, | 100 | 99.9 | 99.9 | 99.9 | 99.9 | 99.9 |
| Sulfurized Diisobutylene[1] | | 0.1 | | | | |
| Sulfurized Diisobutylene[2] | | | 0.1 | | | |
| Sulfurized Triisobutylene | | | | 0.1 | | |
| Sulfurized Monoisobutylene | | | | | 0.1 | |
| Zinc Sulfonate Complex of Succinimide | | | | | | 0.1 |
| Result | | | | | | |
| Emulsion Stability at 200° F., in days | 21 | 49 | 58 | 51 | 20 | 22 |

Notes:
[1]Manufactured at high pressure
[2]Manufactured at low pressure

DISCUSSION OF EXAMPLES

The results summarized in the Table establish the unexpectedly improved stability afforded by sulfurized diisobutylene, whether formulated at high or low pressure, and sulfurized triisobutylene. Whereas in the absence of any emulsion stabilizer the water-in-oil emulsion was stable for 21 days, the same emulsion provided with sulfurized diisobutylene, produced at high or low pressure retained stability under the same conditions for 49 and 58 days, respectively. Similarly, the use of sulfurized triisobutylene effected thermal stability in the same emulsion for 51 days.

On the other hand, when closely related sulfurized monoisobutylene was employed as stabilizer of this emulsion it provided no improved result over the unstabilized emulsion. The emulsion containing sulfurized monoisobutylene was stable for 20 days, 1 day less than the unstabilized emulsion.

The sulfur-containing stabilizer of the prior art, the zinc sulfonate complex of succinimide, provided the emulsion with equally unimpressive stability. This stabilizer increased the period of stability at elevated temperature by only 1 day, to 22 days, over the unstabilized emulsion.

The above preferred embodiments and examples are given to illustrate the scope and spirit of the present invention. These embodiments and examples will make apparent, to those skilled in the art, other embodiments and examples These other embodiments and examples are within the contemplation of the present invention. Therefore, the instant invention should be limited only by the appended claims.

What is claimed is:

1. A process for providing thermal stability to a water-in-oil emulsion base fluid, said emulsion characterized by the presence of between about 40 to 80 percent by weight of an oil of lubricating viscosity; at least about 10 to less than about 60 percent by weight water; about 0.5 to 15 percent by weight of a water-in-oil emulsifier selected from sulfonate and amine emulsifiers and mixtures thereof, all said percentages based on the total weight of said emulsion, comprising adding to said emulsion an emulsion stabilizing amount of between about 0.01 and 2 percent by weight, based on the total weight of said emulsion of a stabilizer selected from the group consisting of sulfurized diisobutylene, sulfurized triisobutylene and mixtures thereof.

2. A process in accordance with claim 1 wherein said stabilizer is sulfurized diisobutylene.

3. A process in accordance with claim 1 wherein said thermal stabilizer is sulfurized triisobutylene.

4. A process in accordance with claim 1 wherein said thermal stabilizer is a mixture of sulfurized diisobutylene and sulfurized triisobutylene.

5. A process in accordance with claim 1 wherein said oil of lubricating viscosity is present in a concentration of between about 50 percent and 70 percent by weight; said water is present in a concentration in the range of between about 10 and 50 percent by weight; and said emulsifier is present in a concentration of between about 1 and 10 percent by weight, all said percentages based on the total weight of said emulsion.

6. A process in accordance with claim 1 wherein said stabilizer is present in a concentration in the range of between about 0.05 and 1 percent by weight, based on the total weight of said emulsion.

7. A process in accordance with claim 6 wherein said stabilizer is present in a concentration in the range of between about 0.075 and 0.5 percent by weight, based on the total weight of said emulsion.

8. A hydraulic fluid having lubricating and inflammability characteristics consisting of a water-in-oil emulsion basestock comprising about 40 to 80 percent by weight, based on the total weight of the emulsion, of an oil of lubricating viscosity; at least about 10 to less than about 60 percent by weight, based on the total weight of said emulsion, of water; between about 0.5 percent and 15 percent by weight based on the total weight of said emulsion of a water-in-oil emulsifier selected from sulfonate and amine emulsifiers and mixtures thereof; and an emulsion stabilizing amount between about 0.01 and 2 percent by weight, based on the total weight of said emulsion, of a stabilizer selected from the group consisting of sulfurized diisobutylene, sulfurized triisobutylene and mixtures thereof.

9. A hydraulic fluid in accordance with claim 8 wherein said emulsifer is a zinc alkylbenzene sulfonate.

10. A water-in-oil emulsion base fluid comprising as the continuous phase about 40 to 80 percent by weight, based on the total weight of the emulsion, of a oil of lubricating viscosity; at least about 10 to less than about 60 percent by weight, based on the total weight of said emulsion, of water as the discontinuous phase between about 0.5 percent and 15 percent by weight, based on the total weight of said emulsion of a water-in-oil emulsifier selected from sulfonate and amine emulsifiers and mixtures thereof; and an emulsion stabilizing amount between about 0.01 and 2 percent by weight, based on the total weight of said emulsion of a stabilizer selected from the group consisting of sulfurized diisobutylene, sulfurized triisobutylene and mixtures thereof.

11. An emulsion in accordance with claim 10 wherein said emulsion stabilizer is sulfurized diisobutylene.

12. An emulsion in accordance with claim 10 wherein said emulsion stabilizer is sulfurized triisobutylene.

13. An emulsion in accordance with claim 10 wherein said emulsion stabilizer is a mixture of sulfurized diisobutylene and sulfurized triisobutylene.

14. An emulsion in accordance with claim 10 wherein said oil of lubricating viscosity is present in a concentration in the range of between about 50 and 70 percent by weight; said water is present in a concentration of about 10 to 50 percent by weight; and said emulsifier is present in a concentration of about 1 and 10 percent by weight, said percentages based on the total weight of said emulsion.

15. An emulsion in accordance with claim 10 wherein said stabilizer is present in a concentration in the range of between about 0.05 and 1 percent by weight, based on the total weight of said emulsion.

16. An emulsion in accordance with claim 15 wherein said stabilizer is present in a concentration in the range of between about 0.075 and 0.5 percent by weight based on the total weight of said emulsion.

17. An emulsion in accordance with claim 10 wherein said emulsifier is a zinc alkylbenzene sulfonate.

* * * * *